US007911334B2

(12) United States Patent
Busey

(10) Patent No.: US 7,911,334 B2
(45) Date of Patent: Mar. 22, 2011

(54) ELECTRONIC PERSONAL ALERT SYSTEM

(76) Inventor: Andrew Busey, Austin, TX (US)

( * ) Notice: Subject to any disclaimer, the term of this patent is extended or adjusted under 35 U.S.C. 154(b) by 265 days.

(21) Appl. No.: 12/106,850

(22) Filed: Apr. 21, 2008

(65) Prior Publication Data

US 2008/0258913 A1 Oct. 23, 2008

Related U.S. Application Data

(60) Provisional application No. 60/912,843, filed on Apr. 19, 2007.

(51) Int. Cl.
*G08B 1/08* (2006.01)

(52) U.S. Cl. ..... 340/539.1; 340/506; 455/412.2

(58) Field of Classification Search ..... 340/539.1, 340/506, 531, 539.18, 539.19, 7.58, 7.51, 340/7.52; 455/412.1, 412.2, 404.1; 719/318
See application file for complete search history.

(56) References Cited

U.S. PATENT DOCUMENTS

| | | | | |
|---|---|---|---|---|
| 6,617,969 | B2 * | 9/2003 | Tu et al. | 340/539.1 |
| 6,650,238 | B1 * | 11/2003 | Britton | 340/539.1 |
| 7,391,314 | B2 * | 6/2008 | Lemmon | 340/506 |
| 7,522,038 | B2 * | 4/2009 | Edwards et al. | 340/539.1 |
| 7,542,773 | B2 * | 6/2009 | Koch | 455/412.2 |

* cited by examiner

*Primary Examiner* — John A Tweel, Jr.
(74) *Attorney, Agent, or Firm* — Fish & Richardson P.C.

(57) ABSTRACT

A personal alert system for sending alerts or notifications in certain conditions. An alert is created by a user, primary contact, first responder or other third party, and an alert message is sent to designated contacts. An alert message can provide an update on a pending alert. Alerts can be configured to be triggered by preselected trigger conditions or can be sent in real time. Triggered alert can include a specific date and time or specific rules or alert conditions. Additional criteria can be applied, such as the constraint to check-in periodically during an alert period. If the user fails to meet an alert condition (e.g., check-in by a certain time), then the alert is triggered and an alert message is sent primary and secondary designated contacts. In another implementation, an emergency first responder can trigger the alert based on information on an emergency card stored in the user's wallet.

20 Claims, 12 Drawing Sheets

1000 plerts personal alerts

Home | My Contacts | My Alerts | FAQs

My Account | Add Contact | Add Alerts | Logged in as: mailvert | Logout

Add a Contact

1010 First Name: Bob
Last Name: Doe

1012 Relationship: Friend
(optional)

1014 Primary Contact: ○ Yes ◉ No

Email #1: bob.doe@anonymous.com } 1016

Email #2: } 1018
(optional)

1020 Phone:
(optional)

1022 SMS cell phone
(optional)

1024 Send SMS?: ○ Yes ◉ No

1026 Personal Note #1:
(optional)

Personal notes are messages written specifically to this individual and are attached to any alert this contact receives from you.

Bob I included you in this emergency contact list because you know how to take care of my dog.

1. Registration

Life changes, plans change. Keeping everyone informed and providing peace of mind is simple and easy with Plerts. First, set up a Plerts account.

2. Add Your Contacts

Next, you'll add the people you want to notify in the case of an event. We'll let your contacts know they have been added to your list, but we'll keep your and their information private.

3. Create Your Alerts

Events can range from a change of plans to a true emergency? Plerts can handle it all. Alerts can be emailed or SMS'd (text message on a cell phone). Setting up an alert is quick and easy, and you can change them at any time.

FIG. 10A

ELECTRONIC PERSONAL ALERT SYSTEM

CROSS-REFERENCE TO RELATED APPLICATIONS

This application claims the benefit of U.S. Provisional Application Ser. No. 60/912,843, filed on Apr. 19, 2007, the contents of which are hereby incorporated by reference for all purposes.

TECHNICAL FIELD

This invention relates to alert systems or notification systems.

BACKGROUND

Emergency notification systems are employed to provide instructions to emergency personnel and/or provide emergency contact information. For example, some systems provide a bracelet or wallet card having medical and other information, which may include a telephone number or website to provide additional information such as contact information in the event of an emergency. Other emergency notification systems provide users with an emergency button that can be manually pressed to automatically dial an emergency number or other contact number.

Such systems are typically limited to static information or one-way communication.

SUMMARY

One aspect of the invention features a method of providing an automated personal alert service. The method includes storing one or more contact information records associated with a user; storing one or more alert records associated with the user including one of a scheduled activation time and a trigger condition, the one or more alert records further comprising a designation of the one or more contact information records for use in delivering an alert message. The method further includes monitoring whether the user performs one of delaying and cancelling the one of the scheduled activation time and trigger condition; determining the arrival of the scheduled activation time or the occurrence of the trigger condition; and upon determination of the arrival of the scheduled activation time or occurrence of the trigger condition, and absent cancellation of the scheduled activation time or trigger condition, automatically sending an alert message to a primary designated contact according to the one or more contact information records.

In one application, the delaying or cancelling includes the user checking-in with the automated alert service.

Another application includes sending a second alert message to a secondary designated contact upon determining that the primary contact is non-responsive.

In another application, the trigger condition includes notification of an emergency by a first-responder.

In another application, the trigger condition includes failure to arrive at or depart from a preselected location.

In some cases, sending an alert message includes sending at least one of an email, SMS message, text message, instant message, facsimile transmission, recorded message and mailed message.

Another application includes sending additional alert messages to additional designated contacts or through alternative message delivery channels until the alert is acknowledged by a designated contact or the user.

Another application further includes providing access for the designated primary contact to acknowledge receipt of the alert message.

Another application includes providing access to a designated contact to generate a reverse alert message to the user.

In some cases, the method includes sending a reminder message regarding a pending alert to one of the user and a designated contact.

Another application includes advancing the scheduled activation time a preselected interval upon confirmation of user status by the user or a designated contact.

In some cases, confirmation of user status is received by at least one of an email message, website login, SMS message, text message, instant message, facsimile transmission, and mailed message.

Another application includes contacting an emergency responder upon determination of the arrival of the scheduled activation time or occurrence of the trigger condition.

The method of claim 1, further comprising sending an alert message to a designated secondary contact at the request of a designated primary contact.

Another aspect of the invention features an automated personal alert system including an alert server; and a memory operably coupled to the alert server for storing at least one alert record comprising a preselected alert trigger condition data and designated contact information data. The system further includes a communications interface on the server for receiving a communication from one of the user and a designated contact; a monitor module for determining the occurrence of a trigger condition according to the preselected alert trigger condition data; and a messaging module for sending an alert message to a designated contact upon determination of the occurrence of the trigger condition.

In one implementation, the alert server is an internet server.

In another implementation, the communications interface is configured to permit one of a user and a designated contact to schedule, reset and cancel an alert.

In another implementation, the communications interface is configured to permit a designated contact to generate a reverse alert message to the user.

In another implementation, the messaging module is configured to escalate alert message delivery to subsequent designated contacts according to escalation criteria stored in the alert record.

In another implementation, the alert record includes a user generated delayed message to a particular designated contact and the messaging module is configured to deliver the delayed message to the particular designated contact at a predetermined time after determination of the occurrence of the trigger condition.

A personal alert system is provided for sending alerts or notifications in certain pre-selected conditions. An alert is generally a message that is sent on behalf of a user to his or her designated contacts in an emergency or upon occurrence or non-occurrence of a predetermined event. An alert message is created by user and sent to one or more designated contacts or contact lists (e.g., a primary contact, first responder or other third party). In some embodiments, an alert can also be updated to enable the user to give a contact an update on a pending alert.

An alert can be set as an instant alert or a triggered alert. For example, an instant alert is sent to contacts upon setting the alert. A triggered alert can include a specific date and time to send the alert. In some implementations, specific rules or alert conditions can be assigned to trigger the alert. For example, one alert condition is triggered if the user does not check-in by date X and time Y. In some implementations, additional criteria can be established, such as the constraint to check-in periodically during or following an alert period, in one implementation, when the alert condition is created, it also includes an alert message. Preferably, the alert message can be personalized by the user to include text, images, or referral information.

In another implementation, an alert indicates that the alert recipient should seek to contact the alert creator or a third-party regarding the alert.

In another implementation, if the user fails to meet an alert condition (e.g., check-in or confirm well-being by a certain time), then the alert is triggered. The alert system sends the alert message to one or more of the user's contacts according to the options chosen. Alert messages and contacts can be updated by the user.

In some implementations, one or more primary contacts can create alerts for a user. For example, the primary contact can select a user in their contact list who has designated them as a primary contact. As another example, the user can select the link sent to them in one of the example messages sent with the alert message. In another implementation, an emergency first responder can trigger the alert based on an emergency card stored in the user's wallet, for example.

The details of one or more embodiments of the invention are set forth in the accompanying drawings and the description below. Other features, objects, and advantages of the invention will be apparent from the description and drawings, and from the claims.

DESCRIPTION OF DRAWINGS

FIGS. 10A-B collectively show a screenshot of an "add contacts" screen of one alert system.

Like reference symbols in the various drawings indicate like elements.

DETAILED DESCRIPTION

Figure 1:
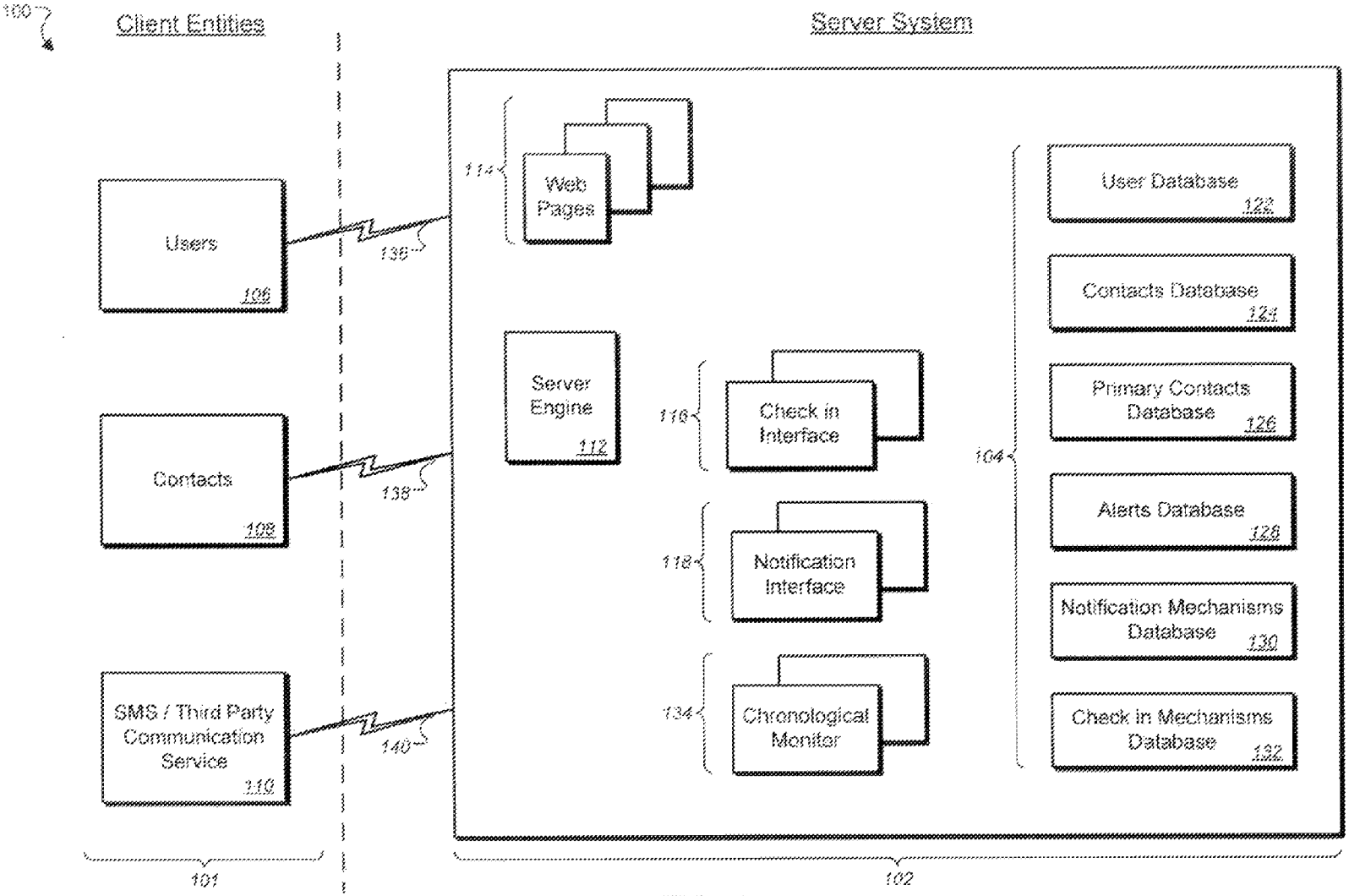
FIG. 1 is an architectural diagram of an internet-based alert system.

FIG. 1 is an architectural diagram representation of an internet alert system 100 that can be used to create, schedule, manage and deliver alert messages for a personal alert system, according to one embodiment. Internet alert system 100 can generate alert messages to automatically notify one or more predetermined contacts about a particular user's whereabouts, status, health, change in plans or other information deemed important by the user. In general, an alert message can be sent on behalf of the user of internet alert system 100 to his or her contacts to report when an event has occurred. As such, alert system 100 can be used as an "In Case of Emergency" (ICE) notification. For example, the user may be traveling without an itinerary and internet alert system 100 can be used as a "safety net" in case the user fails to check-in with system 100, or some emergency occurs.

Internet alert system 100 can be a web-based system where users define time-based rules that can trigger alert messages to be sent to a list of contacts. As such, alert system 100 may generate the alert messages for one or more contacts in a server 102 for presentation in one or more client devices over a network. An alert message can be a formatted email, but other mediums may be used. For example, the client devices may encompass a personal computer, a network computer, a wireless data port, a smart phone, a personal data assistant (PDA), a mobile phone, a landline phone, a home automation system or any other suitable electronic device used for receiving data and viewing messages.

In various aspects, internet alert system 100 can generate an alert message for one or more predetermined contacts in a variety of formats. For example, an alert message can take the format of an SMS message (e.g., a short message or a text message to a mobile phone), an email, a phone call to a landline or mobile phone, an email, SMS, or a phone call to a PDA, a message to another suitable wireless device, or even a regular paper mail letter or other suitable alert mediums. Thus, contacts may receive or retrieve timely information regarding a particular user's status. In particular, the internet alert system 100 can centrally manage user data, contact data and alert data for various users in the personal alert system. Alert system 100 can maintain an interface where several alert messages can be sent to one or more contacts upon request. For example, alert messages pertaining to multiple contacts within alert system 100 can be simultaneously presented or delivered to several client devices.

In one implementation, the user may wish to create an alert to be delivered to the cell phone of a family member if extenuating circumstances occur, such as not checking in, for example to confirm the late arrival, according to a predetermined deadline. For example, the user may set a particular alert because she has a date planned with an unknown person from an online dating site, and wishes to ensure her contact (e.g., the family member) knows if she does not check-in with the system before a scheduled time. Here, the user may set an alert with multiple check-in milestones that can be met by sending an SMS message from the user's cell phone, for example.

As another example, the internet alert system 100 can be used to monitor elderly parents without seeming overly intrusive while still monitoring their health status, or whereabouts. In that example, system 100 sends an alert message to the designated contact children if the elderly parent does not check-in on a predetermined schedule. As another example, an alert message can be set up in a situation where the user has a large sum of cash on his person and plans to retrieve an online purchase. The alert may be triggered to notify one or more contacts with information regarding the exchange if the user does not check-in after the exchange.

In some implementations, internet alert system 100 can provide access to a user's primary contacts to trigger an alert message on the user's behalf. For example, a predetermined primary contact can trigger one or more alert messages if the user does not respond in time to a scheduled alert. In other words, the primary contact receives a notice when the user misses a "check-in" deadline and can respond to notify other contacts on a predetermined list. The primary contact may be given access to the user's contact list.

Referring to the illustrated embodiment in FIG. 1, alert system 100 includes, or is communicably coupled with user entities 101 and the server system 102. The client entities 101 include users 106, contacts 108, and one or more third-party communication services 110. The term "user," as used herein, refers to a system subscriber, or in general to one or more parties having access to or interfacing with internet alert system 100. Similarly, the term "contact," as used herein, refers to one or more parties assigned a contact status by a user of personal alert system 100 to receive alerts or notifications. In general, third-party communication service 110 can include any service capable of contacting users 106 and contacts 108 through alert system 100. One preferred service is short message service (SMS).

The server system 102 hosts web-based alert system 100 for creating, managing and delivering alert messages for multiple personal alert systems. Server system 102 comprises one or more computers operable to receive, transmit, process and store data associated with alert system 100. Although FIG. 1 illustrates one server system 102 that may be used with the disclosure, alert system 100 may be implemented using computers other than servers, as well as a server pool. Server system 102 can be any computer or processing device, such as, for example, a blade server, general-purpose personal computer (PC), Macintosh, workstation, Unix-based computer or any other suitable device.

According to one implementation, server system 102 can also include or be communicably coupled with a server engine 112 and/or a mail server. As shown in FIG. 1, server system 102 includes the server engine 112 for serving web pages to client devices across the Internet or an intranet. Server engine 112 generally hosts web pages 114 that can be associated with internet alert system 100. Web pages 114 can also be associated with scripts, programs and multimedia files. Server engine 112 can serve web pages 114 using a protocol such as HTTP (Hypertext Transfer Protocol), or other applicable protocols. A preferred embodiment, similar to many commercial web sites, employs hypertext preprocessor (PHP), which generally runs on the web server taking PHP code as its input and creating web pages as output. PHP may also be used for command-line scripting or other server-side scripting. Preferably an Apache web server is used with an SQL database install, for example, the popular MySQL, providing database capabilities. Other server architectures may be used, for example a Microsoft .NET architecture or a proprietary service architecture run on a network such as a cellular phone network.

In general server system 102 presents a user access to system features through web pages 114. A user may enter contact data, alert data and notification/check-in data in the various depicted database tables 122-132. Check-in type alerts are nullified by timely check-in through a web page, telephone call or text message or other check-in interface, or they can be activated by monitor 134 absent timely check-in. Upon activation, notification is sent through notification interface 118.

In particular, the depicted system employs one or more databases 104 to house user data. The depicted database tables 122-132 may be tables or separate databases, or in some instances, may be combined within a table. For example, contacts and primary contacts may be stored in the same table, with a primary designation. Therefore, while a "database" is described with regard to FIG. 1, various data structures and tables may be used. The user database or table 122 can store user accounts (e.g., personal alert system accounts) as well as user preferences. Similarly, the contacts database or table 124 can store contact information as well as contact preferences related to the users stored in the user database or table 122. The primary contacts database or table 126 can store a Boolean value or other indicator designating a first set of contacts that represent a subset of the contacts database or table 124. The primary contacts may, in some scenarios, be assigned the authority to access a user's contact list or send a secondary alert message to a different subset of contacts. In addition, the primary contacts database or table 126 can be used as a mechanism to segregate alerts (e.g., send alert message only to primary contacts).

The alerts database or table 128 can store user-defined alert messages with their respective trigger conditions and/or dates and times, and a designated set of contacts to receive alerts. Alerts can be configured with warning notifications to the user explaining that alert conditions are imminent. In some implementations, alert messages can include hyperlinks that direct the user to further information about the displayed message, or about an event associated with the message. For example, the alert message can include a hyperlink to a banking website to verify a particular transaction has occurred on the user's behalf. The alerts database or table 128 can store pending alerts, new alerts, and active alerts, as well as previously configured alerts.

In some implementations, personal notes can be added to any or all alert messages sent to one particular contact. For example, the user can set up an alert message for a contact that includes instructional statements such as "Please take care of my cat if you cannot get in touch with me," or "Please contact my parents so they can get a key to my place." In some implementations, a personal note can be set up as a delayed email message as a "voice from beyond" mechanism. For example, if an alert is triggered and the user has not logged in to deactivate the alert in two weeks, the system may transmit secondary messages, such as preconfigured delayed emails.

The notification mechanisms database or table 130 can be used to identify the media and communication structure alert system 100 used to notify a user or contact with an alert message. The check-in mechanisms database or table 132 may be used to identify the media and communication structure alert system 100 employed for user check-in. For example, a user may enable dial-in, SMS, email, web, and other check-in mechanisms.

Server system 102 further includes a chronological monitor 134. System 102 can employ the chronological monitor 134 to monitor for alerts that are activated. Chronological monitor 134 preferably implements alert notifications by scheduling alerts and alert warnings as a standard chronological alert. This may occur within the alerts database or a separate chronological alert database.

Server system 102 includes control interfaces, such as a check-in interface 116 and a notification interface 118. Check-in interface 116 can process and, timestamp user access to the system 100. For example, the user can access the system 100 to check-in and disable or enable an alert. Check-in interface 116 can process the check-in event and implement requested tasks, for example. Notification interface 118 manages how alert messages are sent to contacts. For example, notification interface 11S can use preference information about a particular contact to determine the preferred method of contact (e.g., email, SMS message, phone call). More than one check-in or notification method may be activated for a particular alert.

Server system 102 can include local electronic storage capacity, such as data repositories. The data repositories can include any memory or database module and may take the form of volatile or non-volatile memory including, without limitation, magnetic media, optical media, random access memory (RAM), read-only memory (ROM), removable media, or any other suitable local or remote memory component. The illustrated database(s) 104 store system data such as message data, alert data, VPN applications or services, firewall policies, a security or access log, print or other reporting files, HTML files or templates, data classes or object interfaces and unillustrated software applications or sub-systems.

In the depicted alert system 100, system server 102 can utilize a restricted computer network, such as a private network created using World Wide Web software, or a public network, such as the Internet. Regardless of the type of computer network utilized, the network (represented abstractly by 136, 138 and 140) facilitates wireless or wireline communication between server system 102, users 106, contacts 108, third-party services 110 and any other local or remote computers, wireless devices or telephone lines using internet alert system 100. In a preferred embodiment, the network is the Internet. The network may also be all or a portion of an enterprise or secured network. In another example, the network may be a virtual private network (VPN) between the clients 101 and server system 102 across a wireline or a wireless link. In certain implementations, the network may be a secure network associated with the enterprise and certain local or remote clients.

Regardless of the particular hardware or software architecture used, internet alert system 100 can be used to create, manage and deliver alert messages for a personal alert system. The following descriptions of methods and screen shots focus on the operation of internet alert system 100, or one of its components or sub-modules, in performing one of the respective methods or processes. However, alert system 100 contemplates using any appropriate combination and arrangement of logical elements implementing some or all of the described functionality.

Figure 2:
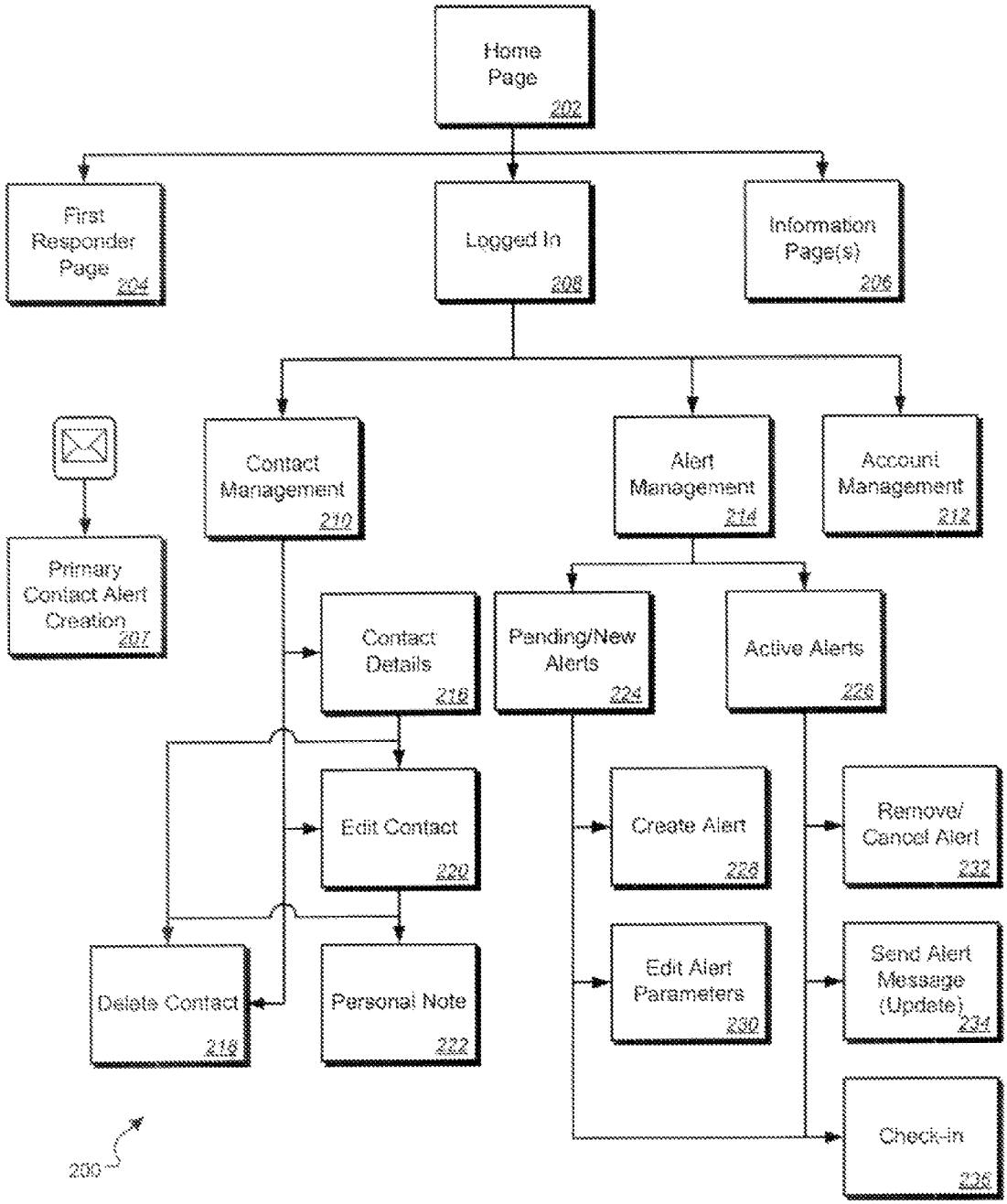
FIG. 2 is a block diagram of an internet-based alert system.

FIG. 2 is a block diagram representation of an internet alert system 200 according to another embodiment. Generally, internet alert system 200 includes a flow of performable tasks and selectable links in an alert system website. A user or contact registered or otherwise associated with internet alert system 200 can begin interacting with the website on the home page 202. From home page 202, the user or contact can choose to visit a first responder page 204 to view active alerts. The user or contact can additionally choose to visit one or more information pages 206 from home page 202. Information pages 206 can include details on how to use internet alert system 200, such as creating contacts, alerts, setting alert preferences and other tasks.

First responder page 204 and information pages 206 can be accessed by users, contacts, and in some implementations, by the general public without having to log in to the website. In particular, the user can choose to allow his or her status to be made public. This can invoke alert system 200 to create a personal status page, such as "www.url.com/user/USERNAME." The personal status page can include the name and status of a user and whether or not alerts are scheduled, imminent, delivered, acknowledged, reset and the like. In some implementations, other indicators can be displayed on the personal status page. For example, an "OK" symbol or icon indicating that the user has no pending or outstanding alert can be displayed. Additionally, the last check-in time can also be displayed to the public. In some implementations, the personal status page can be created as a plug-in, pop-up or pop-under advertisement or other format that can be added to weblogs, desktops, mobile phones or PDAs.

In some implementations, contacts or other parties can create alerts from the personal status page. However, the personal status page can implement a deferral period or approval process such that the user is contacted if someone creates a new alert or an alert that is not valid per preset preferences. As such, the user may have a time period in which to cancel the new alert before it triggers any events or goes live. In some implementations, a contact or user can remotely create a primary contact alert 207 using an email message.

The user or contact can also log in 208 to the internet alert system 200 from the home page 202. Upon logging in, the user can select various links to perform tasks on the website. As shown in FIG. 1, the user can select a contact management link 210, an account management link 212, and an alert management link 214 from the home page 202. If the contact management link 210 is selected, the user can be presented with a webpage having options to view contact details 216, delete contacts 218, edit contacts 220, and view or add personal notes 222. Other options are possible. Contact management will be further described with reference to FIGS. 10A-B.

If the account management link 212 is selected, the user can be presented with a webpage to view account details, such as username, email address, contacts available, and alerts. In addition, the user can modify the information in the account management page and view the last date the information was updated. In some implementations, further help information for navigating the website can also be presented on the account management webpage.

If the alert management link 214 is selected, then the user can be presented with a webpage to view alert details. In particular, the user can view links to pending or new alerts 224 or active alerts 226. The link to pending or new alerts 224 enable a user to create an alert 228 or to edit alert parameters 230. The link to active alerts 226 enable a user to remove or cancel an alert 232, or to send an alert message (e.g., update) 234. Both the pending or new alerts links 224 and the active alerts link 226 can include a link 236 to check-in regarding one or more alerts. Although the above examples refer to the user viewing the internet alert system 200, the contacts can also view the website content provided appropriate login information is used. Other links and options are possible.

Figure 3:
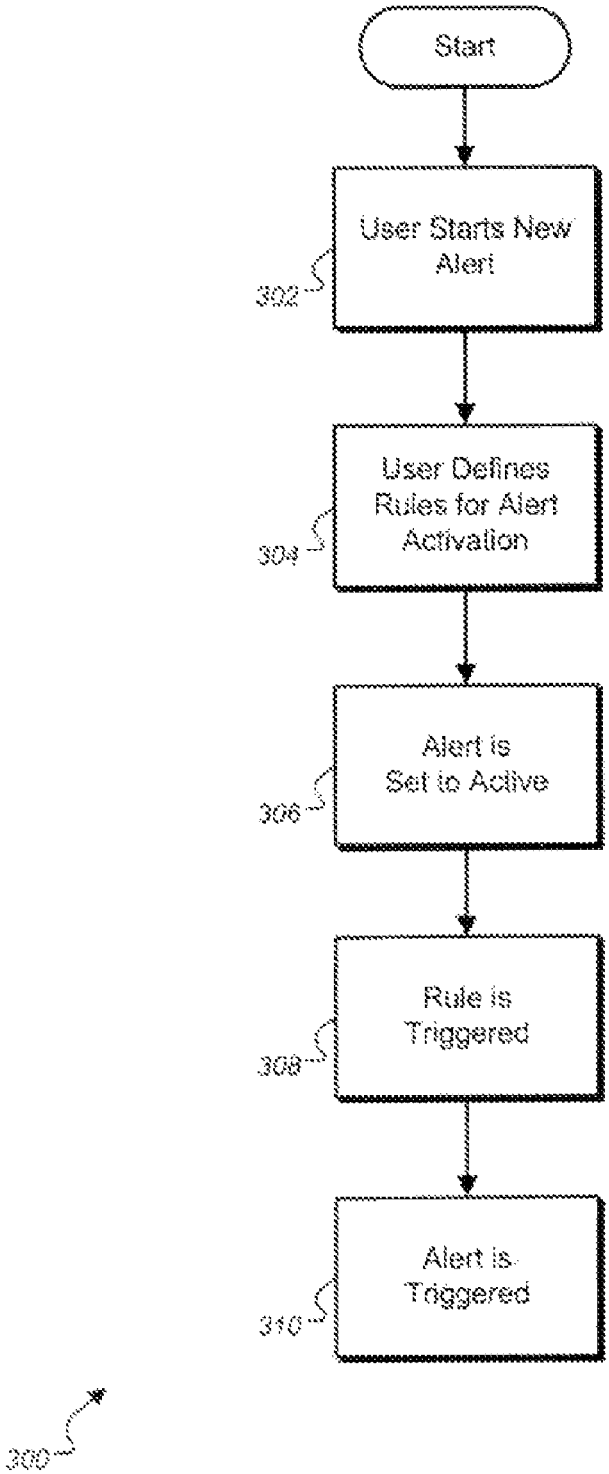
FIG. 3 is a flow chart of an alert scheme according to one embodiment.

FIG. 3 is a flow chart of an alert method 300 according to one implementation. Alert method 300 can be performed as a sequence of events by a user in combination with internet alert system 100, for example. Generally, the operations in alert method 300 can be performed by a processor executing instructions stored in a computer program product. Alert method 300 begins when the user starts 302 a new alert. For example, the user can create a basic alert to be sent to contacts according to preference. The user can add preferences to the alert by defining 304 rules for alert activation. For example, the user can create an alert condition, such as "If I do not check-in by date X and time Y, send alert message." Upon determining alert conditions, the alert message can be constructed as a document that includes relevant user data. The relevant user data can include items such as a travel itinerary, instructions, or remote contact information, to name a few examples. In some implementations, the alert may include milestones for a user to meet over time. For example, the user may set up five alerts over five days to ensure a daily status check is performed. Other durations are possible, including periodic alerts.

After the new alert is created and rules for activation have been defined, the operations of alert method 300 include setting 306 the alert to active. The alert remains pending until one or more of the preset conditions or rules are triggered 308. As shown in FIG. 3, when one or more rules are triggered, the alert is triggered 310 and the alert message is sent to one or more of the specified contacts. In some implementations, the alert message can also be sent to the user's specified device.

For example, the alert can be used as a reminder mechanism for the user. In some implementations, an alert can be created that is instantly triggered without an underlying rule, such as in an emergency situation when there is no time to place phone calls to all of the contacts in the personal alert system.

Figure 4:
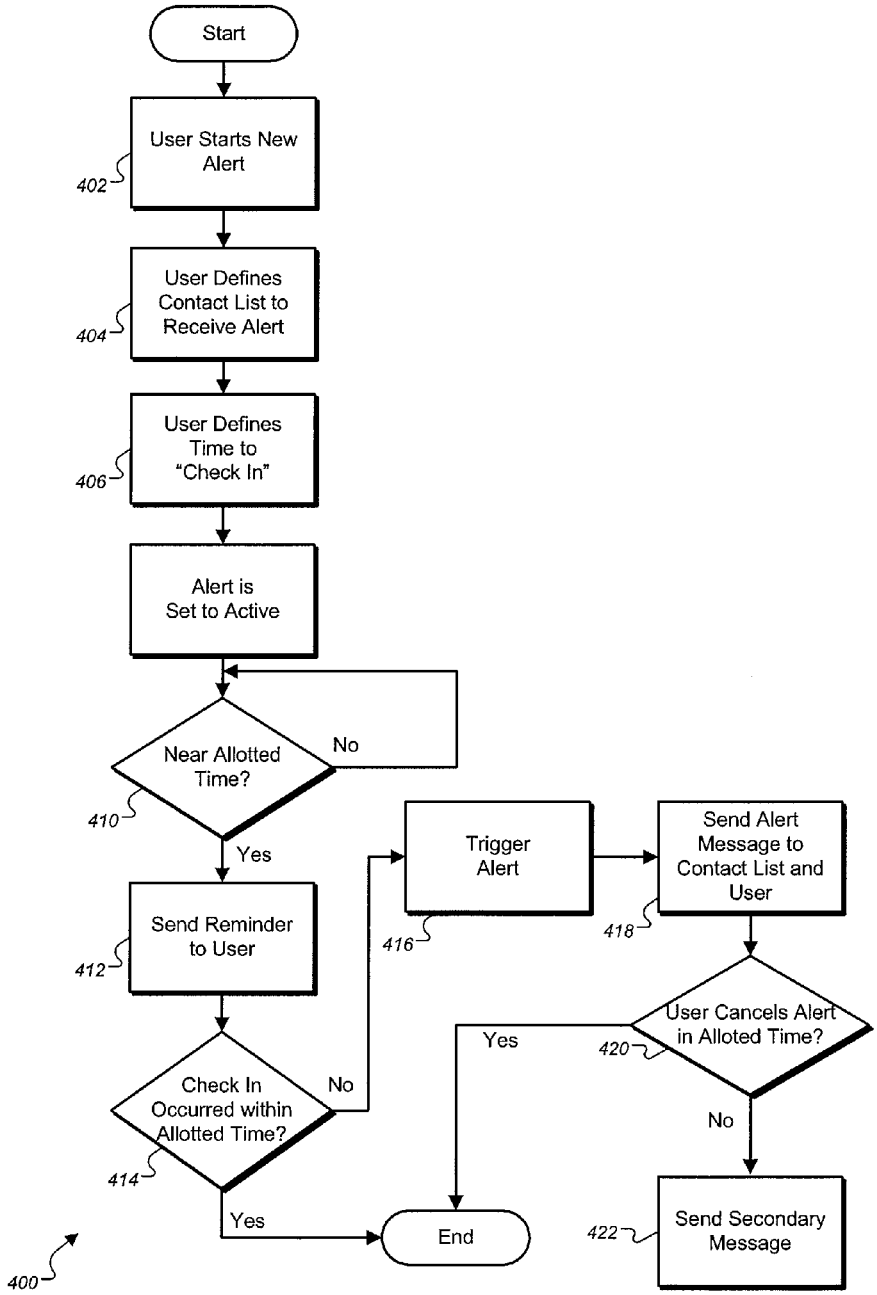
FIG. 4 is a flow chart of another alert scheme according to another embodiment.

FIG. 4 is a flow chart of another alert method 400 according to another embodiment. The alert method 400 can be performed as a sequence of events by a user of internet alert system 100, for example. The alert method 400 begins when the user selects 402 a new alert. For example, the user can select the create alert link 228 from the website depicted in FIG. 2. Next, the user designates one or more existing contacts or defines 404 new contacts to receive the new alert. In general, when a new contact is added, internet alert system 200 can check to see if the contact is a current alert system user. If the new contact is a current system user, the contact information can be analyzed to ensure it is up to date. Upon adding a contact to alert system 200, a notification can optionally be sent to the identified contact(s).

Next, the user defines 406 a check-in time for the alert. The check-in time can include a single deadline or a multiple deadline and can span over days, weeks, months, or longer. Once the check-in time is defined, the user can set the alert to active status. Additional operations in the flow diagram of alert method 400 can be carried out automatically by alert system 200. As such, the next operation can perform a check 410 to determine if it is near the allotted "alert time." In other words, system 102 monitors whether or not the alert deadline is approaching with monitor 134. If the deadline is not approaching, the system continues to perform 410 the check. If the deadline is approaching, the operations send 412 a reminder to the user to check-in with the system 200. If the check-in does occur 414 within the alert deadline, the alert is completed as nullified. If the check-in does not occur 414 within the allotted time, the alert is triggered 416, the alert message is sent 418 to the predefined contact list.

After the alert is triggered, in this embodiment, in step 420 the system monitors for the user to check-in and cancel the alert within an allotted time. If the user does not cancel, a designated secondary message is sent (step 422). For example, if an alert is triggered and the user has not logged into to deactivate the alert in two weeks the system sends out secondary messages (number 1028, personal note 2, FIG. 10B).

Figure 5:
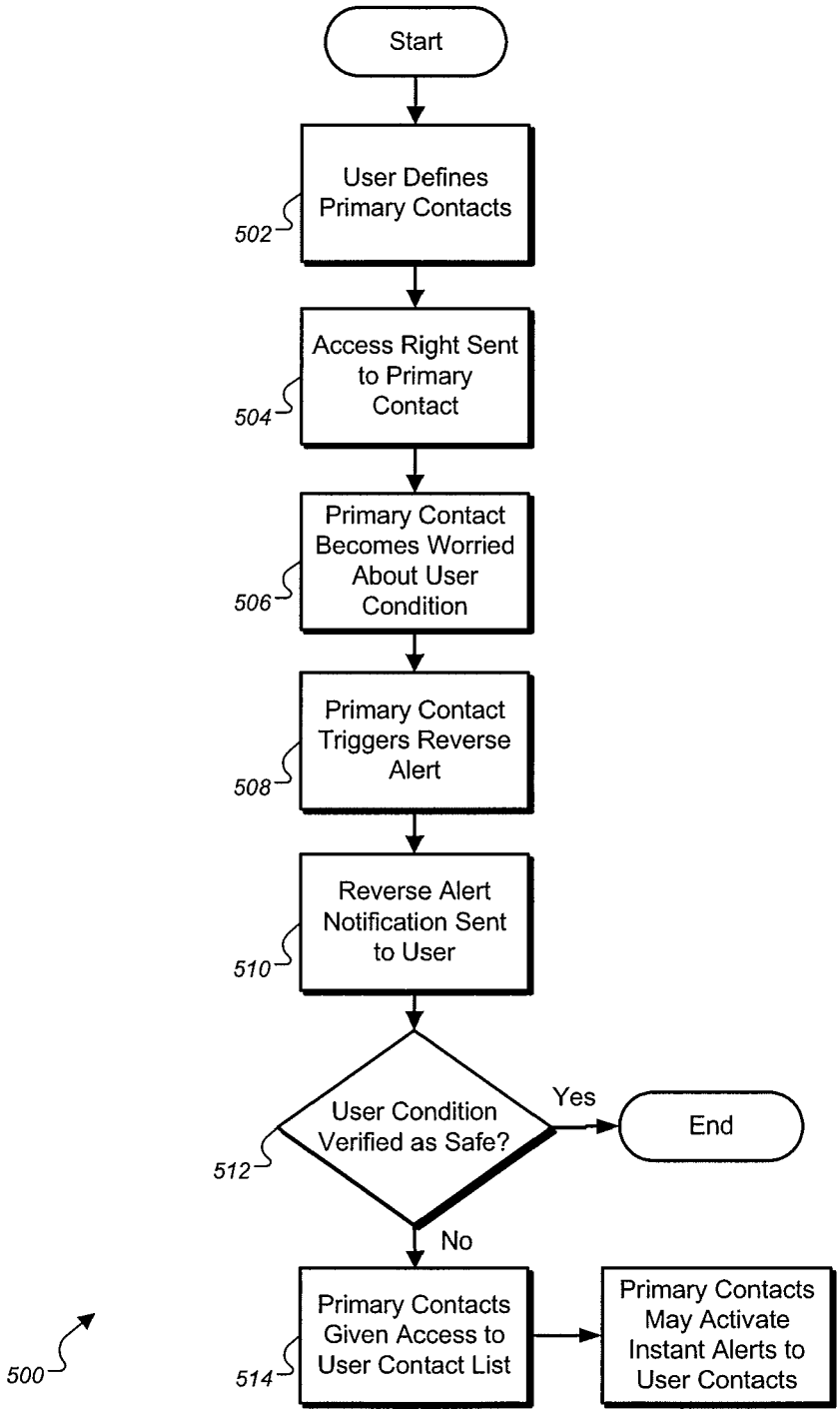
FIG. 5 is a flow chart of another alert scheme according to another embodiment.

FIG. 5 is a flow chart of a reverse alert method 500 according to another embodiment. The alert method 500 can be performed as a sequence of events by a user and primary contacts in combination with internet alert system 100, for example. Alert method 500 begins when the user defines 502 primary contacts. The primary contact is set up similar to a general contact, but can generally be given added functionality or control over the general contacts. For example, primary contacts can be allowed to send an alert on the user's behalf. Accordingly, if something were to happen to the user, the primary contacts can alert other contacts in the system.

In this embodiment, step 502 designates certain primary contacts as having reverse alert initiation capability. These primary contacts are sent a notification such as an email with an appropriate explanation and link giving them specified access rights (step 504). At this point, in this scenario, the user may leave on a trip or go about their ordinary activities, but the primary contact now has access rights to check-in on the user. In step 506 the primary contact becomes worried about the user's status, for example because they have been out of contact and are not answering calls and emails. The primary contact may then employ their access rights through a login or activation link. The primary contact may use the rights to trigger a reverse alert in step 508. In step 510, the reverse alert is sent only to the user. The user must respond to the alert and verify their safe condition (step 512).

If the user does not verify their condition, the primary contact can be given access to the user contact list (step 514) in order to ask for help or information. The primary contact may optionally be able to activate an "instant alert" sent to all or a designated accessible portion of the user's contact list, requesting that he or she get in touch with the primary contact.

Figure 6:
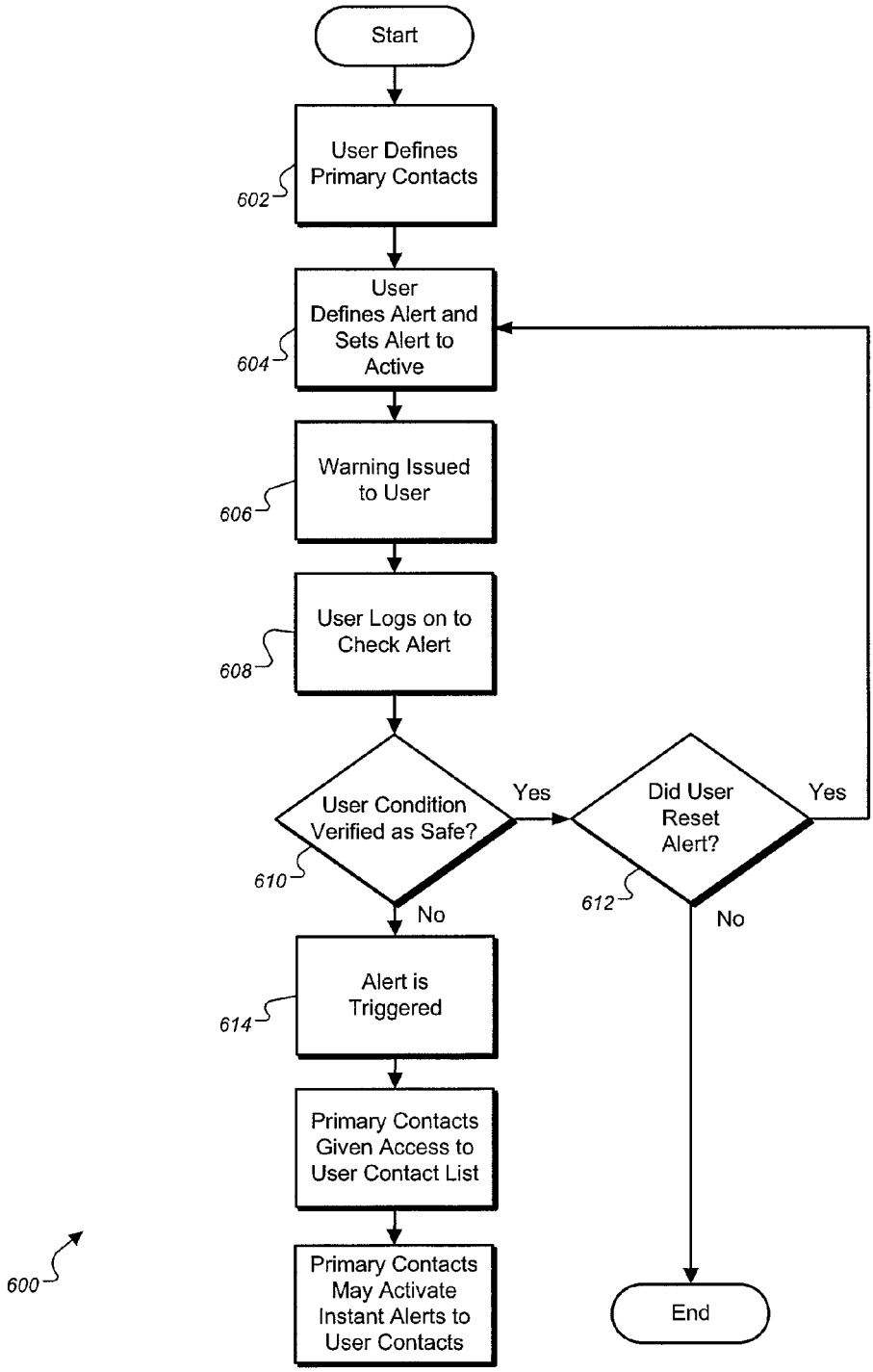
FIG. 6 is a flow chart of a periodic alert scheme according to one embodiment.

FIG. 6 is a flow chart of a periodic alert method 600 according to one embodiment. The alert method 600 can be performed as a sequence of events by a user of the in combination with internet alert system 100, for example. The alert method 600 begins when the user defines 602 one or more primary contacts. Next, the user defines 604 the alert and sets the alert to active. Additional operations in the flow diagram of alert method 600 can be carried out automatically by internet alert system 100, for example. As such, the next operation can issue 606 a warning to the user. The warning indicates that an alert is about to be sent on the user's behalf if the system 100 does not receive the user's status in a predetermined amount of time. In this example, the user logs on to check 608 the alert within the predetermined time. The user can update the contacts with a status, or can reset the alert for another time period. If the user verifies 610 that he is safe, the operations verify 612 whether or not the alert is reset. If the user resets the alert, the operations return to redefine 604 the alert and reset the alert to active. If the user did not reset the alert, the alert may expire. In the event that the user verifies 610 the conditions as unsafe, the alert is triggered 614 and the primary contacts are given access to the user contact list.

Figure 7:
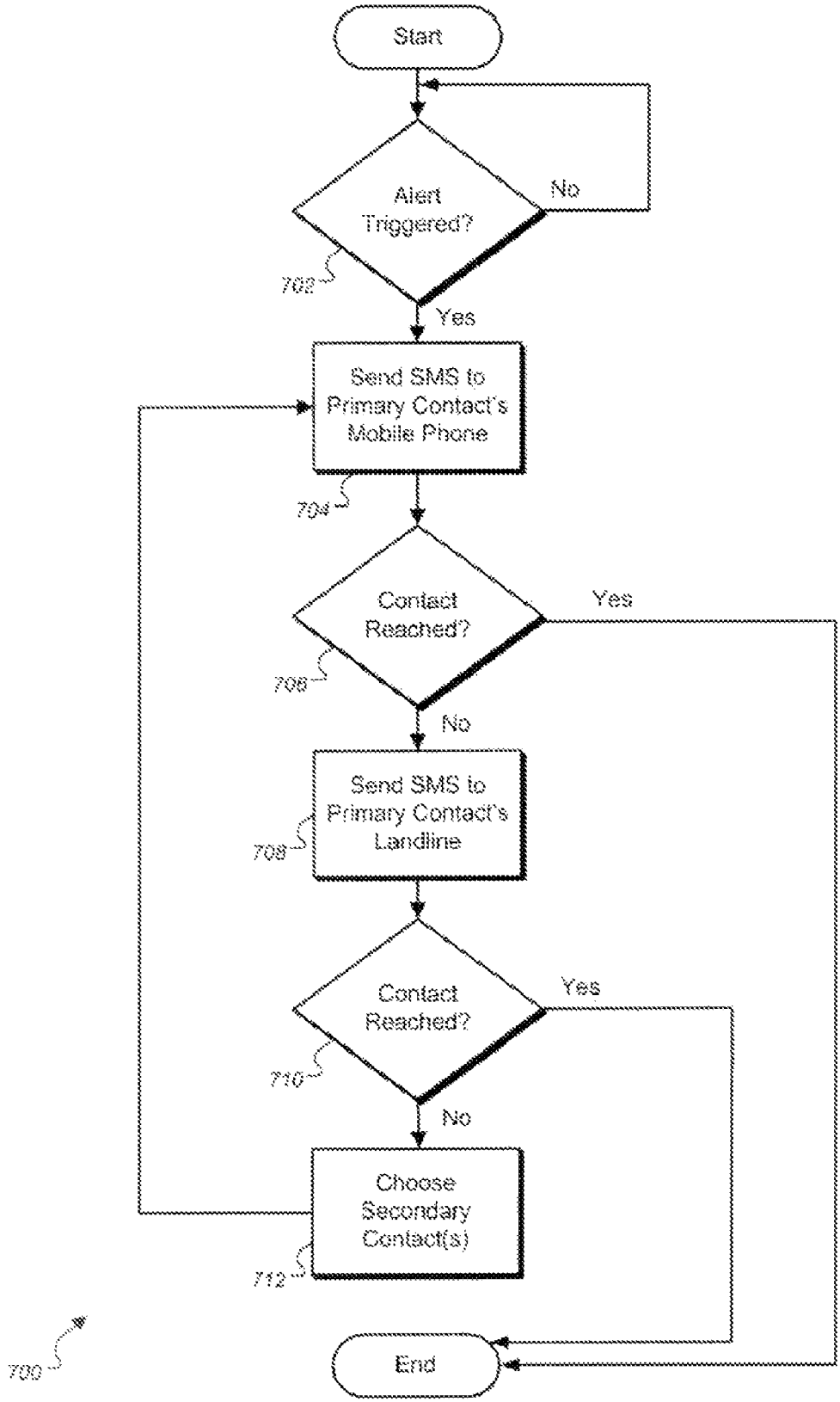
FIG. 7 is a flow chart of another alert scheme according to another embodiment.

FIG. 7 is a flow chart of another alert method 700 according to another implementation. Alert method 700 can be performed as a sequence of events by a user of internet alert system 100, for example. Alert method 700 begins while waiting for an alert to be triggered 702. If an alert is triggered 702, an SMS message is sent 704 to a predefined primary contact's mobile phone or handheld device. The message can include the user's contact information as well as further instructions for the contact to carry out.

In some implementations, alert system 100 can determine 706 whether the SMS has reached the primary contact's mobile phone, as well as if further instructions have been carried out. If alert system 100 determines that the primary contact has been reached, the alert process ends. If alert system 100 determines 706 that the primary contact has not been reached, or the received instructions have not been carried out by the primary contact, alert system 100 sends 708 the SMS to the primary contacts landline phone with an automated message. If the system 100 determines 710 that the primary contact's landline phone has been reached, the alert process ends. For example, if there is no voicemail on the landline phone and the phone is unanswered, the SMS may not get through to the contact. The process may proceed to try email or other contact methods. If alert system 100 determines 710 that the primary contact has not yet been reached, a secondary contact list can be selected 712. The operations return to send 704 the SMS to the secondary contact's mobile phone. In some implementations, the process can be repeated until a contact is reached, or until the system eliminates the contacts available.

The depicted implementation allows a user to specify an escalation order of contacts to try and reach in the event a particular alert is activated. For example, the user may want the system to try and reach his girlfriend by all available means before moving on to his parents.

Figure 8:
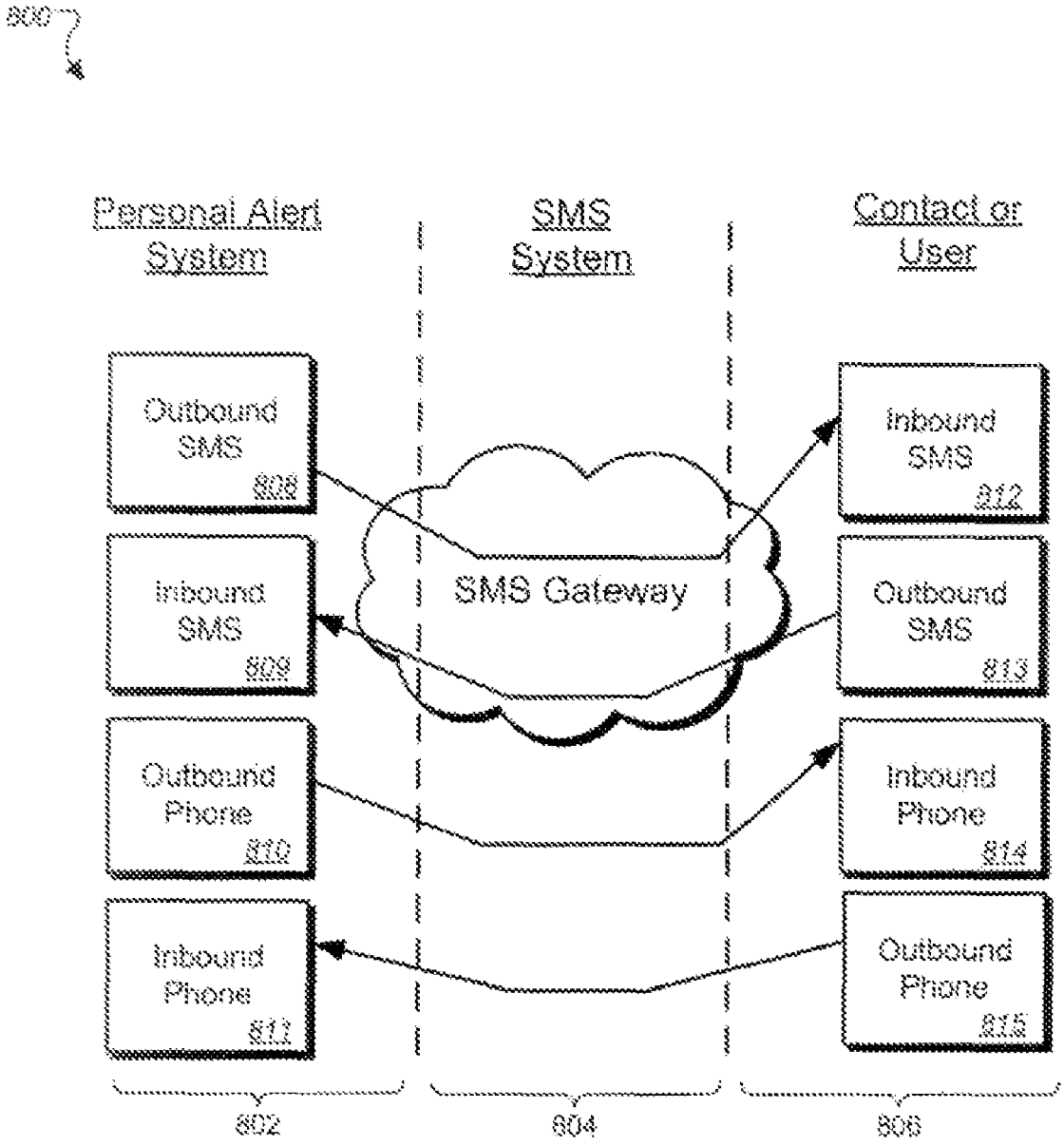
FIG. 8 is a block diagram of an SMS to phone architecture.

FIG. 8 is a block diagram of an SMS to phone architecture 800. Architecture 800 can be used in the alert systems described in this disclosure. In particular, architecture 800 can be used to enable SMS communication between alert system 100 and a mobile phone, a landline phone, a website, or an email account, to name a few examples. Architecture 800 includes a personal alert system 802, an SMS system 804, and a contact system 806. In general, personal alert system 802 can use SMS system 804 to send messages to contact system 806.

Personal alert system 802 includes an outbound SMS module 808 that can send outbound SMS alert messages. For example, outbound SMS module 808 can send an SMS directly to the contact or user system 806. The depicted communication interface modules are SMS and phone modules, but other communications means may be used. For SMS communications, personal alert system 802 may use outbound SMS interface 808 to send warnings or alert to users or contacts. SMS system 804 includes an SMS gateway architecture allowing for the sending and receiving of SMS messages to or from devices other than a mobile phone. For example, the SMS gateway may allow sending and receiving SMS messages to email, landlines, websites, mail servers, home automation systems, and others. Inbound SMS interface 809 allows user check-in functionality and contact functionality such as reverse alert activation through inbound SMS messages.

Similarly, system 802 includes inbound and outbound phone communication modules for interfacing with users and contacts by telephone. These modules may include recorded messages, text to speech capability, and touch tone menus. Users can check-in through inbound phone interface 811. Warnings may be sent through outbound phone interface 810. Alerts can include a call to contact through outbound phone interface 810. For example, system 802 can call a contact as part of an alert. When the contact answers the phone, an automated voice reads the text message and allows for a response by means of voicemail.

In some implementations, the SMS system architecture 804 can allow the personal alert system 802 to send SMS messages to be received as email. This type of service may enable users who do not have a computer (or do not have current access to one), but do have a mobile phone, to receive email at their mobile phone.

In some implementations, personal alert system 802 can be set up to send alerts using SMS messages to a home automation system. For example, some home automation systems may have the ability to accept SMS messages from personal alert system 802. As such, the alert message may indicate when to turn on lighting or initiate services on a kitchen appliance. The system can send an SMS confirmation message when the requested action has been performed.

Figure 9:
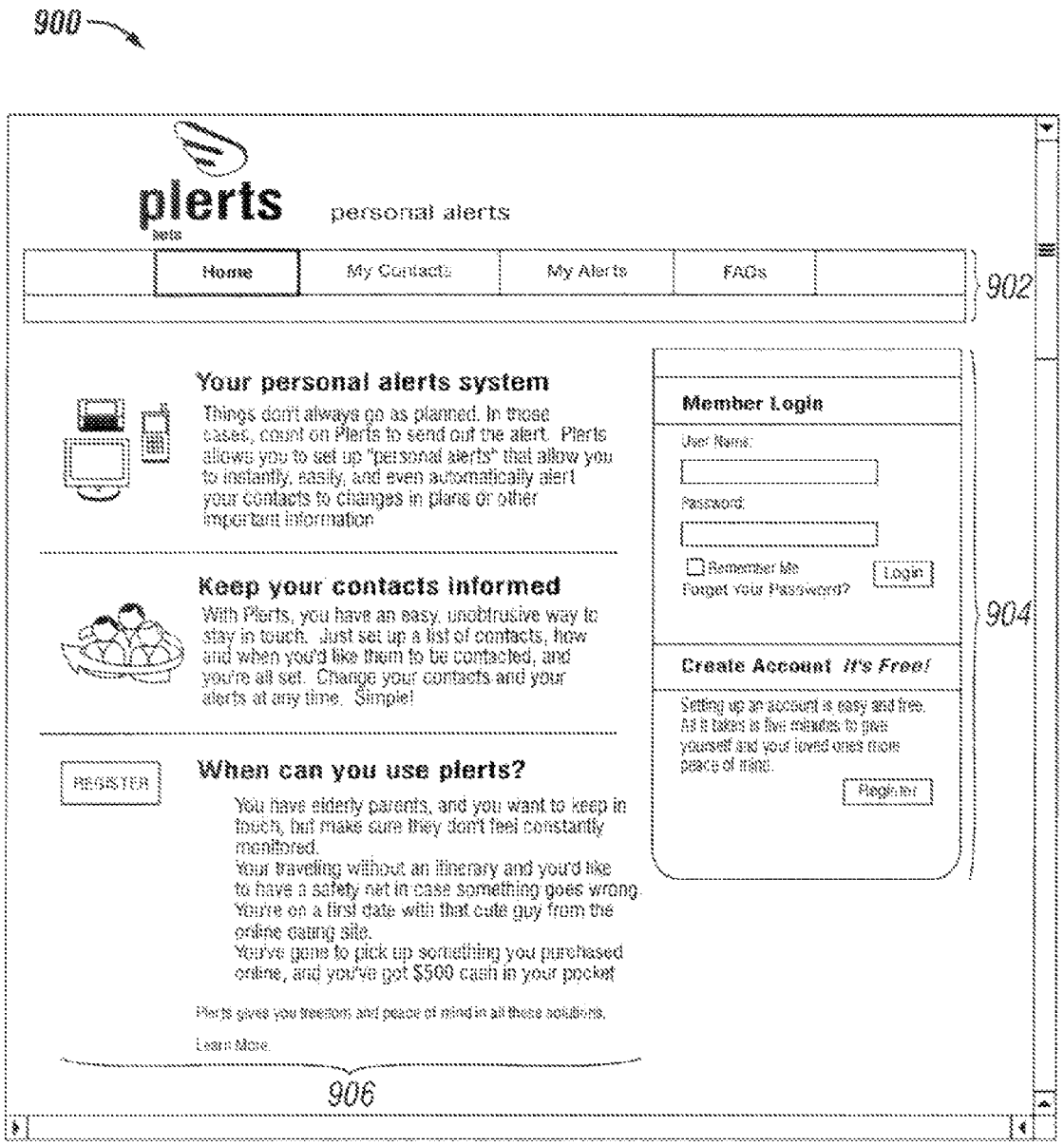
FIG. 9 is a screenshot of a login screen of another implementation of an alert system.

FIG. 9 is a screenshot of a login screen 900 of one implementation of an alert system. Login screen 900 can be used to access user account information, contact information and alert information. Login screen 900 includes a menu bar 902 and a member login area 904 where the user can login or register for a new account. The menu bar 902 can provide the user with product information and access to contacts and alerts already defined in the system as well as further instructions for using the website. Login screen 900 also includes several informational frames 906 about the alert system. In general, login screen 900 allows users to register for a personal alert system account, login to an existing account, view alerts, and learn more about the personal alert system. Users or contacts can access the login screen upon receiving a message to view, enable, or disable alerts. For example, if a predefined contact received an alert message with the URL of this website, the contact would be prompted to login for further information.

When the user logs on to the alert system, alert conditions can be checked. For example, if the user logs on, a notification indicating that they have one or more pending alerts can be displayed. The alert may include a message asking the user to verify that everything is ok. If the user verifies this, they have the option of extending the alert condition (e.g., if it is ending). This can also allow the addition or modification of the alert message, such as an extension to a trip.

Figure 10B:
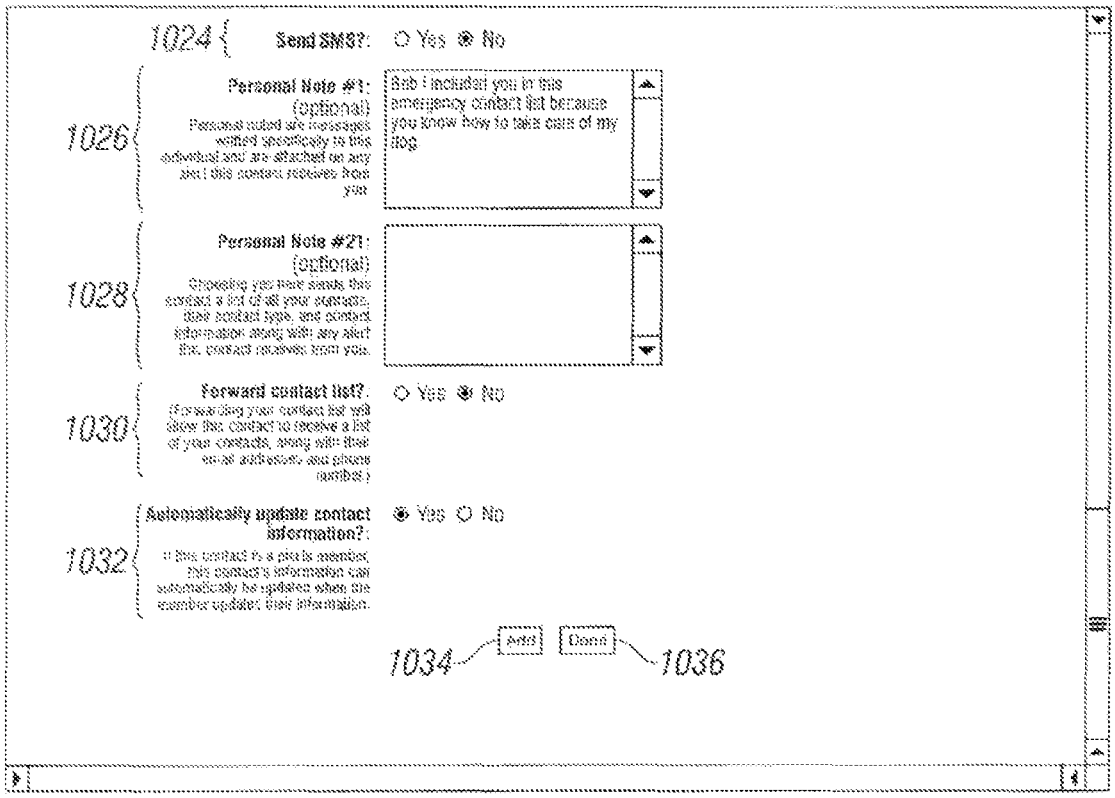

FIGS. 10A-B collectively show a screenshot of an "add contacts" screen 1000 of one alert system. The "add contacts" screen 1000 can be navigated to after the user logs into the login screen 900, for example. The "add contacts" screen 1000 is a contact management interface that provides a database for organizing contacts. New contacts can be added or edited from the "add contacts" screen 1000. When a new contact is added, the system can determine whether the new contact is a current system user. Further, if the contact is a current system user, the system can ensure the contact information is up to date. The system can then construct an email regarding the alert system and can send the email to the new contact. In some implementations, a sent email may be bounced back to the system. In such an event, the user can be notified.

In general, the email can include instructions to inform the contact about the purpose of the alert system. The constructed email can take various forms and can be user-editable. For example, the user can configure the email messages to be categorized according to the type of contact receiving it. One such categorization scheme can be to construct emails for existing system users and non-system users. The categories can further be split into designated primary contacts and general contacts. The following four example emails follow the above categorization scheme.

EXAMPLE 1

Existing System User/Designated Primary Contact

Dear CONTACT,

I have designated you as a primary contact in my personal alert system. I use my personal alert system as a way to make sure that if something should happen to me that my family, friends, co-workers, and associates, know about it. To make sure that they know, I have designated you as a primary contact. This means that if you find out that something has happened to me (such as serious hospitalization or death) you can alert them.

While I hope it is never necessary, you can respond to an alert by clicking the following URL: URL. You can also use this link to update information and preferences.

Thank you in advance for helping me—it is important to me that the people I have listed in my personal alert system be notified in certain circumstances.

Sincerely,

USER

EXAMPLE 2

Existing System User/Not Designated Primary Contact

Dear CONTACT,

This message is to let you know that I have listed you as a contact in my personal alert system. Should anything happen to me the system will automatically notify you.

Because you are an alert system member, if you update your contact info in the alert system, it will also automatically update on my contact list so that you receive any important alerts.

Sincerely,

USER

EXAMPLE 3

Not an Existing System User/Designated Primary Contact

Dear CONTACT,

This email is to let you know that I have recently signed up for a new personal alert service. The service allows me to create a list of people that will receive alerts in the event something happens to me.

I have designated you a primary contact in the alert system. I use my personal alert system as a way to make sure that if something should happen to me that my family, friends, co-workers, and associates, know about it.

To make sure that they know, I have designated you as a primary contact. This means that if you find out that something has happened to me (such as serious hospitalization or death) you can alert them.

While I hope it is never necessary, you can respond to or create an alert by clicking the following URL: URL.

Thank you in advance for helping me—it is important to me that the people I have listed in my alert service be notified in such circumstances.

Sincerely,

USER

EXAMPLE 4

Not an Existing System User/Not Designated Primary Contact

Dear CONTACT,

This email is to let you know that I have recently signed up for a new personal alert service. The service allows me to create a list of people that will receive alerts in the event something happens to me.

Since I use my personal alert system as a way to make sure that if something should happen to me that my family, friends, co-workers and associates know about it. I have added you to my list of contacts who will receive such a notification.

While I hope you never receive alerts on my behalf from the alert system, it is important that you add the alert system address to your email white list or anti-spam filters. It may be the only way you receive a notification or update if something should happen to me.

Sincerely,

USER

Turning to the illustrated embodiment, the user can use the alert screen 1000 to enter contact information. Alert screen 1000 includes several field entities used to distinguish one contact from another. The field entities include a name field (e.g., first, last) 1010, a relationship field 1012 (optional), a primary contact field 1014 (e.g., yes or no—defaults to no), a first email field 1016, a second email field 1018 (optional), a phone field 1020 (optional), an SMS field 1022 (optional), a Send SMS field 1024 (e.g., yes or no—defaults to no), and a personal note field (optional) 1026.

The name fields (e.g., First, Last) 1010 are text entry boxes where names can be added by the user. In some implementations, the user may upload a current address book from another source. For example, the user may upload a spreadsheet, mail file, or other document having delimited contact information. In this example, the system can automatically fill in the contact fields to the extent possible. Advantageously, using an uploaded file can allow the names, email addresses, and phone numbers to be automatically filled for the user.

The relationship field 1012 can indicate the relationship to the user. Here, the field 1012 is shown as a selectable drop-down box. The selections can be friend, family, coworker or other, for example.

Examples: Delayed itinerary delivery if alert not deactivated by expected arrival time.

The primary contact field 1014 can be selected for one or more contacts entered. Primary contact field 1014 can be used as a mechanism to segregate alerts (e.g., send only to primary contacts).

The first email field 1016 is generally used as the primary contact point for the personal alert system. However, other contact points can be designated instead. As such, the second email field 1018, the phone field 1020, or the SMS field 1022 can be used as primary or secondary contact points.

The send SMS field 1024 can be used to send a text message to the number on file. The text message can include information from fields such as the personal note field 1026. The personal notes are messages written specifically to this individual contact which can be attached on any alert this contact receives from the user. In some implementations, the text message can deliver a message for the contact to call a landline telephone for further instructions. For example, the contact could call to hear a voice recording of instructions from the user.

As shown in FIG. 10B, the field entities continue with a second personal note field (optional) 1028, a forward contact list option 1030 (e.g., yes or no), and an automatically update contact information option 1032 (e.g., yes or no). The second personal note field 1028 can be used for a second alert message in the case that the user has set up multiple rules for sending specific messages.

The forward contact list option 1030 allows this contact to receive a list of the user's contacts, along with their email addresses and phone numbers. The automatically update contact information option 1032 automatically updates this contacts information when an update is available when the contact is a personal alert system member. Once the contact information has been filled into the alert screen 1000, the user can select an "Add" button 1034 to add the contact to the contact database.

In some implementations, the user may wish to edit or update the contact information already stored in the system. In some implementations, the system can find users who have added a selected user to their contacts list and update the contact information. As shown, the user can also select the "Done" button 1036 to simply update the modified information. The edit functionality does not typically generate emails or other activities unless the user has changed the primary contact field 1014 from a contact to a primary contact. In such an example, the system sends the contact the primary contact email, such as "Example 1" above, Similarly, the user may wish to delete a contact. The user can select one or more contacts for deletion and select a delete function (not shown). A verification of deletion message can be presented to the user to ensure the deletion is not an error. The user can verify the deletion and the contact(s) are removed from the contact list.

Figure 11:
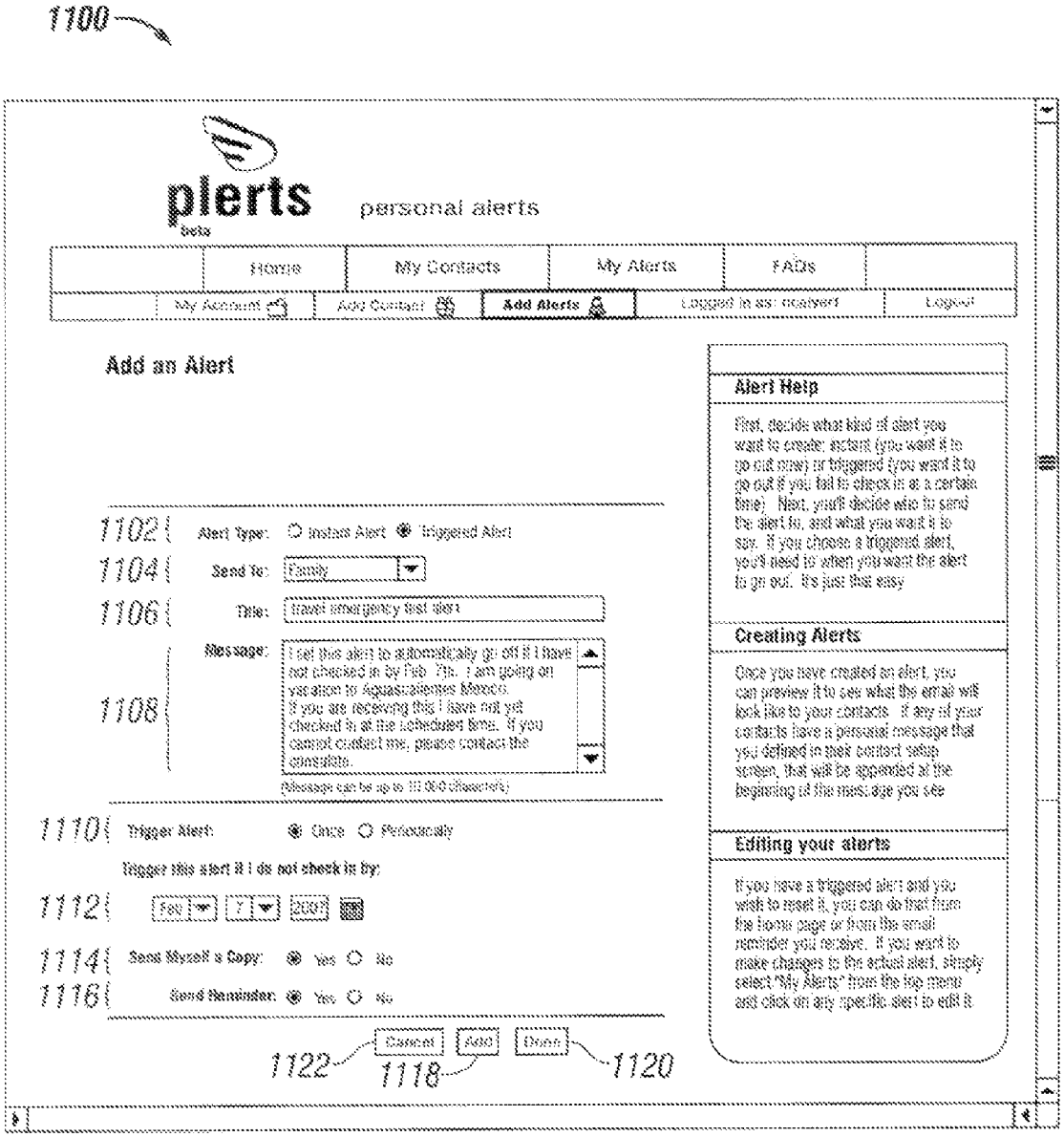
FIG. 11 is a screenshot of an "add alerts" screen of one alert system.

In some implementations, the user can also trigger an alert for a particular contact if the contact has designated the user as a primary contact. For example, an option or mark next to the contact name in the user's contact list can signify this and enables the user to create an alert. The user is typically sent to a URL for the contact to create the alert. In some implementations, the URL may include security measures to enter. FIG. 11 is a screenshot of an "add alerts" screen 1100 of one alert system. The "add alerts" screen 1100 can be accessed by a user logged into system 200, for example. An alert is generally a message that is sent on behalf of the user to their contacts to let them know something has happened. An alert message is created by the alert creator (e.g., the user, a primary contact, or a first responder or third party, depending on the condition) and sent to one or more contact lists. The user may specify individual contacts or entire contact classes (e.g., friends, family, coworkers) to receive a particular alert. An alert can also be updated to enable the user to give their contacts an update on a pending alert. As such, the user can quickly send a new personal message to the same set of recipients.

Alerts can be configured to be a specific type, such as an instant alert or a triggered alert. For example, the instant alert is sent to contacts upon setting the alert. The triggered alert may include a specific date and time to send the alert. In some implementations, specific rules or alert conditions can be assigned to trigger the alert. For example, the user can create an alert condition such that if the user does not check-in by date X and time Y, then trigger the alert. In some implementations, additional criteria can be applied, such as the constraint to check-in periodically during the alert period. In general, when the alert condition is created, it also includes an alert message. The alert message can be personalized by the user to include several, text, images, or referral information. For example, the user may cut-and-paste a copy of a travel itinerary, or can enter a free-form entry outlining the rough path for a road trip.

If an alert condition is met (e.g., failure to check-in by a certain time), then the alert is triggered. The alert sends the alert message to some or all of the contacts or just the primary contacts depending on the options chosen when the alert was created.

In some implementations, one or more primary,contacts can create alerts for a user. For example, the primary contact can select a user in their contact list who has designated them as a primary contact. As another example, the user can select the link sent to them in one of the example messages sent with the alert message. In some implementations, the link may have been saved in the contact's favorite menu, or otherwise stored on the contact's personal computer.

In another implementation, an emergency first responder can trigger the alert. If the emergency first responder triggers an alert, the alert can be verified by the use of the user's identifier, presumably pulled from a card in their wallet. The emergency first responder can use the information to login to a user's personal alert system. Upon logging in, the emergency first responder is presented with a screen asking them to provide contact information. In some implementations, further questions such as "Did you find this wallet?" or "What kind of emergency is this?" The first responder can then trigger the alert. In some implementations, the first responder is presented with the primary contacts contact information to contact the person directly.

In another implementation, a third party can trigger the alert. This can be triggered by either a user that has been added as a contact or by any user (who registers) if Public Status is enabled. In general, a delay can be implemented to give the user a chance to block the alert in the event that the alert is not legitimate.

As shown in FIG. 11, the screen 1100 can be used to configure a triggered alert. As such, an "Alert Type" selection field 1102 is selected as a triggered alert. The user also determines who to send the alert to. For example, the user can select one or more contact lists from a "Send To" dropdown box 1104. The alert can be titled in the "Title" text field 1106 and the alert message can be constructed in the "Message" text field 1108.

The alert trigger mechanisms can also be configured using screen 1100. The trigger alert can be set up as a one time event or to occur periodically. For example, a "Trigger alert" selection 1110 can be used to configure the alert as a one time event or a periodic event. In addition, the trigger data can be set using the selection 1112. In some implementations, the user can choose to configure other additional features. For example, the user can choose to send a copy to himself using a "Send myself a copy" selection 1114. As another example, the user can choose to send a reminder to himself before the alert triggers using a "send reminder" selection 1116.

After configuring the alert, the user can select an "Add" button 1118 to add the alert to the personal alert system. In some implementations, the user may simply make a modification to an existing alert. Here, changes can be updated when a "Done" button 1120 is selected. In some implementations, the user can choose to make their alerts public, in which case, the alert creator is prompted to enter a public message.

Upon activating the alert, there are various methods in which the alert can be triggered. For example, the user can send the alert as an instant alert. In another example, the user's pending alert conditions can trigger the alert. In another example, a primary contact can trigger the alert. In yet another example, a first responder or third party can trigger the alert. Other methods are also possible.

A "Cancel" button 1122 is also available to cancel out of the alert creation and return to view a webpage with the user's other active alerts. The "Cancel" button 1122 also be used to cancel the active alert in view. For example, the user can login to cancel an alert that is deemed no longer useful, but has not yet been sent.

A number of embodiments of the invention have been described. Nevertheless, it will be understood that various modifications may be made without departing from the spirit and scope of the invention. Accordingly, other variations are within the scope of the following claims.

What is claimed is:

1. A method of providing an automated personal alert service, the method comprising:

storing one or more contact information records associated with a user;

storing one or more alert records associated with the user, the one or more alert records comprising one of a scheduled activation time and a trigger condition, the one or more alert records further comprising a designation of the one or more contact information records for use in delivering an alert message;

monitoring whether the user performs one of delaying and cancelling the one of the scheduled activation time and trigger condition;

determining the arrival of the scheduled activation time or the occurrence of the trigger condition; and upon determination of the arrival of the scheduled activation time or occurrence of the trigger condition, and absent cancellation of the scheduled activation time or trigger condition, automatically sending an alert message to a primary designated contact according to the one or more contact information records.

2. The method of claim 1, wherein the one of delaying and cancelling comprises the user checking-in with the automated alert service.

3. The method of claim 1, further comprising sending a second alert message to a secondary designated contact upon determining that the primary contact is non-responsive.

4. The method of claim 1, wherein the trigger condition comprises notification of an emergency by a first-responder.

5. The method of claim 1, wherein the trigger condition comprises failure to arrive at or depart from a preselected location.

6. The method of claim 1, wherein sending an alert message comprises sending at least one of an email, SMS message, text message, instant message, facsimile transmission, recorded message and mailed message.

7. The method of claim 1, further comprising sending additional alert messages to additional designated contacts or through alternative message delivery channels until the alert is acknowledged by a designated contact or the user.

8. The method of claim 1 further comprising providing access for the designated primary contact to acknowledge receipt of the alert message.

9. The method of claim 1, further comprising providing access to a designated contact to generate a reverse alert message to the user.

10. The method of claim 1, further comprising sending a reminder message regarding a pending alert to one of the user and a designated contact.

11. The method of claim 1, further comprising advancing the scheduled activation time a preselected interval upon confirmation of user status by the user or a designated contact.

12. The method of claim 1, wherein confirmation of user status is received by at least one of an email message, website login, SMS message, text message, instant message, facsimile transmission, and mailed message.

13. The method of claim 1, further comprising contacting an emergency responder upon determination of the arrival of the scheduled activation time or occurrence of the trigger condition.

14. The method of claim 1, further comprising sending an alert message to a designated secondary contact at the request of a designated primary contact.

15. An automated personal alert system comprising:

an alert server;

a memory operably coupled to the alert server for storing at least one alert record comprising a preselected alert trigger condition data and designated contact information data;

a communications interface on the server for receiving a communication from one of the user and a designated contact;

a monitor module for determining the occurrence of a trigger condition according to the preselected alert trigger condition data; and a messaging module for sending an alert message to a designated contact upon determination of the occurrence of the trigger condition.

16. The system of claim 15, wherein the alert server is an internet server.

17. The system of claim 15, wherein the communications interface is configured to permit one of a user and a designated contact to schedule, reset and cancel an alert.

18. The system of claim 15, wherein the communications interface is configured to permit a designated contact to generate a reverse alert message to the user.

19. The system of claim 15, wherein the messaging module is configured to escalate alert message delivery to subsequent designated contacts according to escalation criteria stored in the alert record.

20. The system of claim 15, wherein the alert record includes a user generated delayed message to a particular designated contact and the messaging module is configured to deliver the delayed message to the particular designated contact at a predetermined time after determination of the occurrence of the trigger condition.

* * * * *